US007640935B2

(12) United States Patent
Draghetti et al.

(10) Patent No.: US 7,640,935 B2
(45) Date of Patent: Jan. 5, 2010

(54) UNIT FOR FEEDING FILTERS TO A FILTER TIP ATTACHMENT MACHINE

(75) Inventors: Fiorenzo Draghetti, Medicina (IT); Salvatore Rizzoli, Bologna (IT)

(73) Assignee: G.D S.p.A. (IT)

( * ) Notice: Subject to any disclaimer, the term of this patent is extended or adjusted under 35 U.S.C. 154(b) by 807 days.

(21) Appl. No.: 10/549,513

(22) PCT Filed: Mar. 11, 2004

(86) PCT No.: PCT/IB2004/000824

§ 371 (c)(1),
(2), (4) Date: Sep. 20, 2005

(87) PCT Pub. No.: WO2004/082410

PCT Pub. Date: Sep. 30, 2004

(65) Prior Publication Data

US 2006/0196514 A1 Sep. 7, 2006

(30) Foreign Application Priority Data

Mar. 20, 2003 (IT) ..... BO2003A0151

(51) Int. Cl.

| | |
|---|---|
| ***A24C 1/32*** | (2006.01) |
| ***A24C 5/47*** | (2006.01) |
| ***A24C 1/00*** | (2006.01) |
| ***A24C 5/00*** | (2006.01) |
| ***A24C 5/32*** | (2006.01) |
| ***A24C 5/34*** | (2006.01) |
| ***A24C 1/14*** | (2006.01) |
| ***A24C 1/44*** | (2006.01) |
| ***A24C 5/33*** | (2006.01) |

(52) U.S. Cl. ..... 131/88; 131/280; 131/282; 131/55; 131/74

(58) Field of Classification Search ..... 131/280, 131/282, 55, 74
See application file for complete search history.

(56) References Cited

U.S. PATENT DOCUMENTS 4,042,094 A 8/1977 Schmermund (Continued)

FOREIGN PATENT DOCUMENTS

EP 0523613 1/1993

(Continued)

*Primary Examiner*—Khanh Nguyen
*Assistant Examiner*—Matthew Hoover
(74) *Attorney, Agent, or Firm*—Timothy J. Klima; Shuttleworth & Ingersoll, PLC

(57) ABSTRACT

Cigarette filters are supplied to the infeed portion (1) of a filter tip attachment machine by a unit (2) comprising rollers (11) which divert the filters (3) into an upstream hopper (8), and a channel (9) carrying the filters (3) from the upstream hopper (8) to a downstream hopper (4) where they are released to the infeed portion (1) of the machine. Located between the infeed rollers (11) and the feed channel (9) is a variable volume storage buffer (16) with a movable wall (28) attached to the top branch (23) of a conveyor belt (24); the Belt is driven by a motor (27) interlocked to sensors (31) which monitor and control the level of the mass of filters (3) occupying the upstream hopper (8), so that the size and capacity of the buffer (16) can be adjusted to accommodate fluctuations in the flow of filters through the hopper (8).

17 Claims, 2 Drawing Sheets

U.S. PATENT DOCUMENTS

| | | | |
|---|---|---|---|
| 4,222,477 | A | 9/1980 | Molins |
| 4,353,454 | A | 10/1982 | Tolasch |
| 4,580,939 | A | 4/1986 | Dyett |
| 5,103,960 | A | 4/1992 | Brown |
| 5,220,992 | A | 6/1993 | Milins |
| 2003/0091412 | A1 | 5/2003 | Dombek |

FOREIGN PATENT DOCUMENTS

| | | |
|---|---|---|
| EP | 1310178 | 5/2003 |
| GB | 2132969 | 7/1984 |

UNIT FOR FEEDING FILTERS TO A FILTER TIP ATTACHMENT MACHINE

This application is the National Phase of International Application PCT/IB2004/000824 filed Mar. 11, 2004 which designated the U.S. and that International Application was published under PCT Article 21(2) in English.

TECHNICAL FIELD

The present invention relates to a unit for feeding filters to a filter tip attachment machine.

BACKGROUND ART

Conventional filter tip attachment machines are associated typically with filter makers designed to form a continuous filter rod such as can be advanced longitudinally though a cutter head and divided into discrete sticks of length corresponding to a multiple of the length of the filter tip attached to a single cigarette. The cut sticks are then intercepted and fed along a direction transverse to the longitudinal direction followed by the rod, utilizing diverter devices of conventional type such as will convert the axial movement the stick into a movement transverse to its longitudinal axis, and directed thus into the infeed hopper of a filter tip attachment machine. Thereafter, the filter sticks are taken up from the bottom of the hopper onto a roller with peripheral flutes and, still advancing in a direction transverse to their longitudinal axes, conveyed into a further cutting station where they are cut transversely in such a way as to generate double length filter plugs, that is to say plugs twice the length of the filter tip associated with a single cigarette.

It has been found that conventional units for feeding filters as outlined above are unable, when used in combination with ultra high speed filter tip attachment machines of the current generation, to guarantee a constant and correctly ordered supply of filter sticks to the hopper.

In addition, the feed units currently in use are not able to ensure a swift and precise compensation of differences in output between the filter making and filter tip attachment machines.

The object of the present invention is to provide a unit for feeding filters to a filter tip attachment machine that will be unaffected by the drawbacks mentioned above.

DISCLOSURE OF THE INVENTION

The stated object is realized in a unit for feeding filters to a filter tip attachment machine, as recited in claim 1 appended.

The invention will now be described in detail, by way of example, with the aid of the accompanying drawings, in which.

Figure 1:
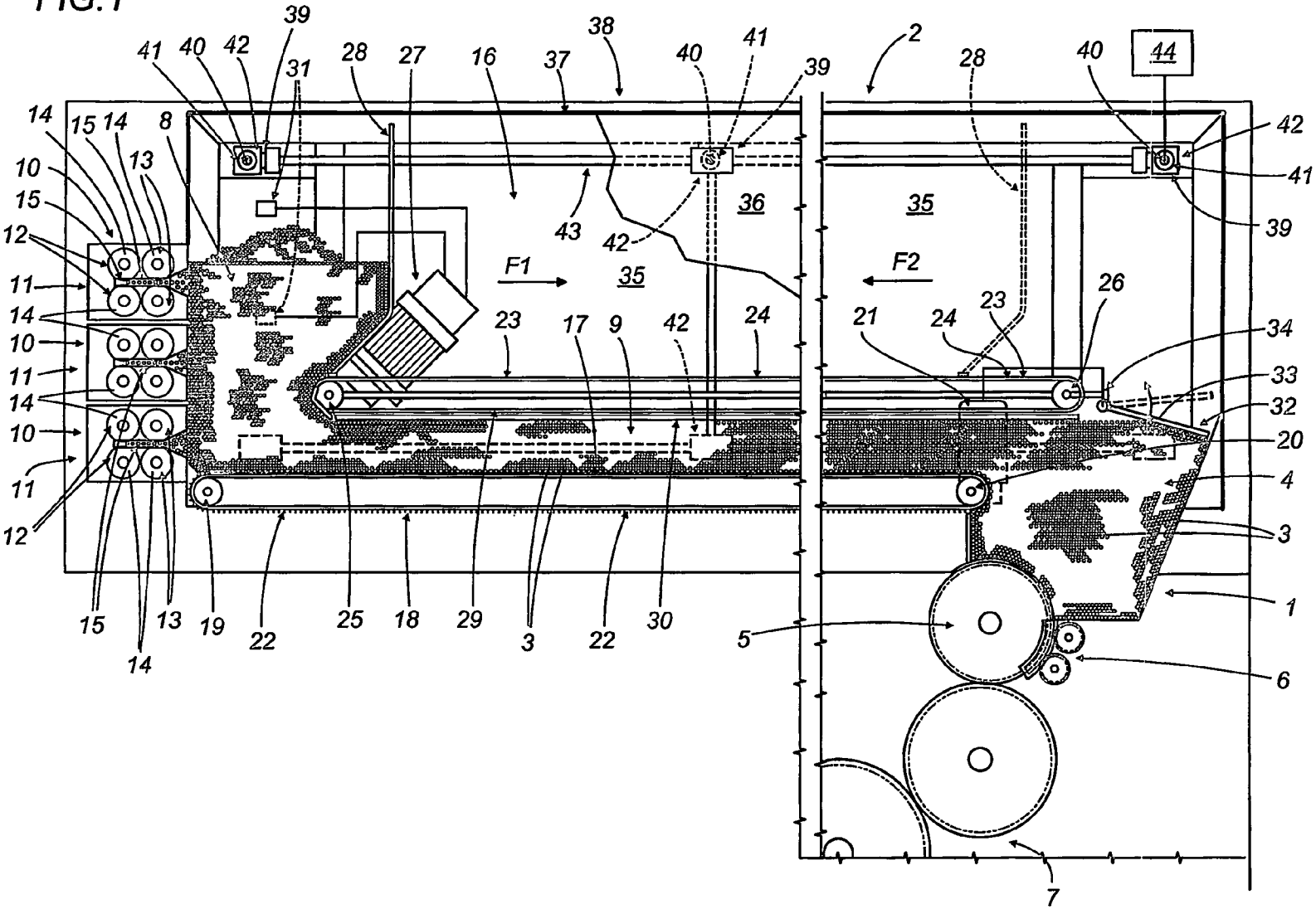
FIG. 1 illustrates a unit embodied in accordance with the present invention for supplying filters to a filter tip attachment machine, viewed schematically in a side elevation with certain parts shown in section and certain parts omitted.

Referring to FIG. 1 of the drawings, 1 denotes an infeed portion of a filter tip attachment machine, and 2 denotes a unit, in its entirety, for feeding filters 3 to the aforementioned infeed portion 1; the unit 2 comprises a dispensing hopper 4 of which the outlet is coupled to the periphery of a roller 5 presenting a succession of axially oriented flutes or grooves, not illustrated, each able to acconmodate a respective filter 3.

The roller 5 is designed to advance the filters 3 in succession along a direction transverse to their longitudinal axes and through a cutting station 6, where each one is cut transversely in such a way as to generate a predetermined number (generally three) of double length filter plugs (not illustrated), that is to say filters twice the length of a filter tip associated with a single cigarette, before being conveyed by a train of rollers 7 toward a user station not shown in the drawings.

The unit 2 feeding the filters 3 also comprises a receiving hopper 8 and a substantially horizontal channel 9 by which this same hopper 8 is connected to the dispensing hopper 4. The receiving hopper 8, which feeds into the channel 9, is filled in its turn with filters by feed means denoted 10 in their entirety and, in the example of FIG. 1, comprising three diverter devices 11 arranged in tiers and serving to redirect the filters 3 from a longitudinal path of movement onto a transverse path. In particular, each diverter device 11 comprises a first pair 12 and a second pair 13 of rollers 14, the two rollers 14 of each pair 12 and 13 occupying a common vertical plane, and the four rollers combining to create a channel 15 that extends from the upstream pair 12 through the downstream pair 13 and emerges into the receiving hopper 8. Filters turned out by a filter making machine (not illustrated) and advancing along a longitudinal path perpendicular to the viewing plane of FIG. 1, are taken up by the rollers 14 of the first pair 12 and diverted onto a path extending transversely to their longitudinal axes, passing along the aforementioned channel 15 between the rollers 14 of the second pair 13 and into the receiving hopper 8.

As illustrated in FIG. 1, the unit 2 comprises an inline storage facility or buffer 16 of elongated geometry and variable volume, located above the feed channel 9, interposed between the channel 9 and the diverter devices 11 and extending from the receiving hopper 8 to the dispensing hopper 4, of which the inlet end coincides substantially with the receiving hopper 8.

The feed channel 9 is delimited at the bottom by the top branch 17 of a horizontal conveyor 18 looped around two return pulleys denoted 19 and 20, located respectively at the upstream and downstream ends. The downstream pulley 20 is power driven by a relative motor 21, and the active surface of the conveyor 18 offered in contact to the filters 3 presents a toothed profile 22.

The variable volume buffer 16 is delimited at the bottom by a wall consisting in the top branch 23 of a conveyor belt 24 looped at opposite ends around an upstream pulley 25 and a downstream pulley 26, the former coupled to a motor 27.

Associated rigidly with the top branch 23 of the belt 24 is the bottom end of a substantially vertical wall 28 rendered capable of movement, generated by the motor 27, between two limit positions of which the first, indicated in solid lines on the left as viewed in FIG. 1, corresponds to a condition of minimum capacity afforded by the buffer 16, and the second, indicated in phantom lines on the right as viewed in FIG. 1, corresponds to a condition of maximum capacity afforded by the buffer 16. It will be seen that in the condition of minimum capacity, the movable wall 28 functions as a side wall of the receiving hopper 8.

The bottom branch 29 of the conveyor belt 24 runs above the horizontal channel 9 and is separated from the channel by a wall 30 serving to disallow contact between the filters 3 and the surface of the belt 24.

The receiving hopper 8 is equipped internally with sensors 31, serving to monitor and control the mass of filters 3 accumulating internally of the hopper 8, to which the motor 27 of the conveyor belt 24 is interlocked. More exactly, the sensors 31 are two in number, positioned in vertical alignment so that the lower of the two will sense a minimum replenishment value and the upper senses a maximum replenishment value for the hopper 8.

The dispensing hopper 4 likewise is equipped with respective means 32 by which to monitor and control the level of the mass of filters 3 accumulating internally of the hopper 4, to which the motor 21 of the lower conveyor 18 is interlocked. Such means 32 comprise a hinged flap 33 resting on the mass of filters 3, also a sensor 34 connected to the flap 33 and capable of indicating its angular position as determined by the level of the mass of filters 3 internally of the dispensing hopper 4.

Figure 3:
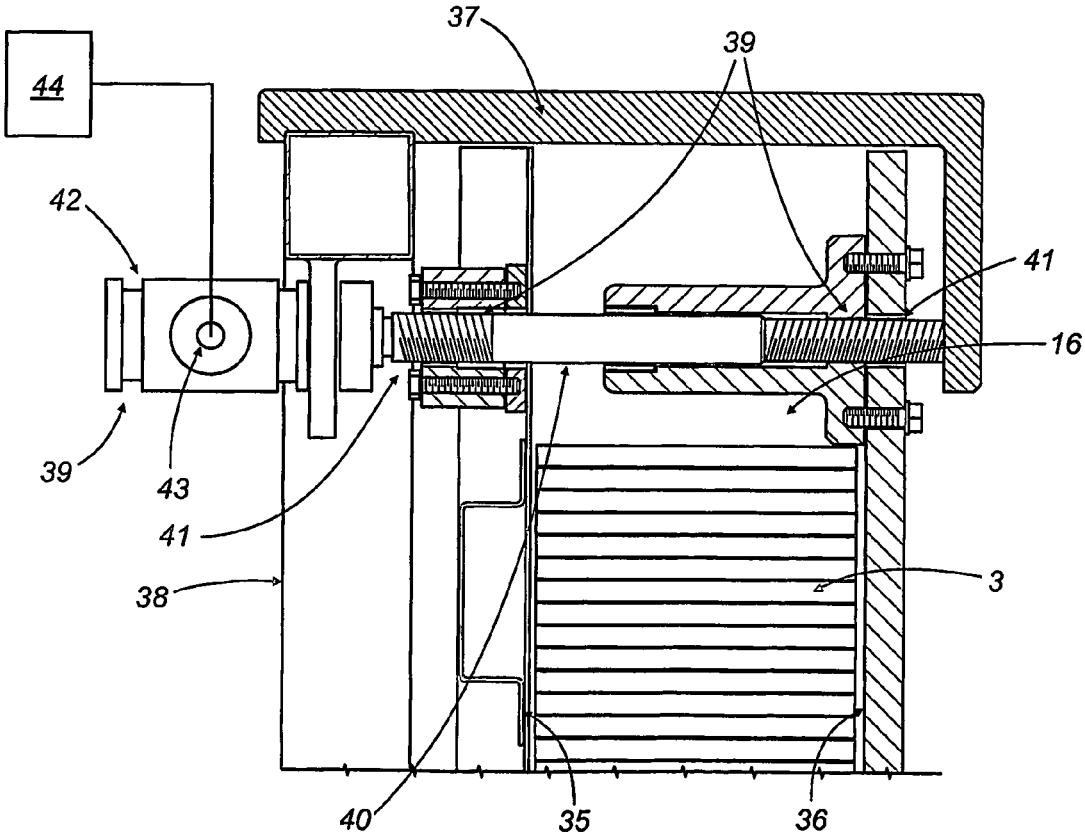
FIG. 3 is a cross sectional view showing the unit of FIG. 1 with certain parts omitted.

With reference to FIGS. 1 and 3, the buffer 16 comprises two vertical side walls 35 and 36 extending substantially perpendicular and parallel to the horizontal conveyor 18. The two side walls 35 and 36, of which FIG. 1 shows the rear wall 35 and a part of the front wall 36, combine with a top wall 37 cantilevered from a frame 38 to define a box-like structure containing the entire unit 2.

The unit 2 comprises means, denoted 39 in their entirety, serving to vary the distance between the side walls 35 and 36. In particular, such means 39 comprise a plurality of rods 40 of which the ends are connected by way of respective lead screw and nut couplings 41 to the two opposite walls 35 and 36.

The rods 40 project externally of the buffer 16 on at least one side and are coupled via the respective ends to angle drive units 42 interconnected by line shafts 43. At least one of the angle drive units 42 is connected to a power driven actuator 44 such as will set the angle drive units 42 and shafts 43 in motion and cause the rods 40 to rotate about their respective axes in one direction or the other.

Thus, by causing the rods 40 to turn on the relative lead screw/nut couplings 41, which present identical threads of opposite hand (one left, one right), the distance between the side walls 35 and 36 can be adjusted to suit the length of the filters 3. In operation, starting for example from a situation with the buffer 16 at minimum capacity, at the moment in which the mass of filters 3 in the receiving hopper 8 exceeds a predetermined maximum value, the level sensors 31 will pilot the motor 27 and the conveyor belt 24 to translate the movable wall 28 toward the dispensing hopper 4 in the direction of the arrow denoted F1, thereby increasing the capacity of the buffer 16.

Conversely, when the mass of filters 3 in the receiving hopper 8 drops below a minimum level, the sensors 31 will trigger the return of the movable wall 28 back toward the hopper 8, in the direction of the arrow denoted F2.

The movable wall 28 thus provides means by which to vary the volume of the buffer 16, whilst the motor 27 and the relative conveyor belt 24 provide means by which to set the wall 28 in motion.

The movement of the horizontal conveyor 18 and its linear speed is controlled by the motor 21, which is interlocked in operation to the sensors 34 monitoring the angular movement of the flap 33.

Figure 2:
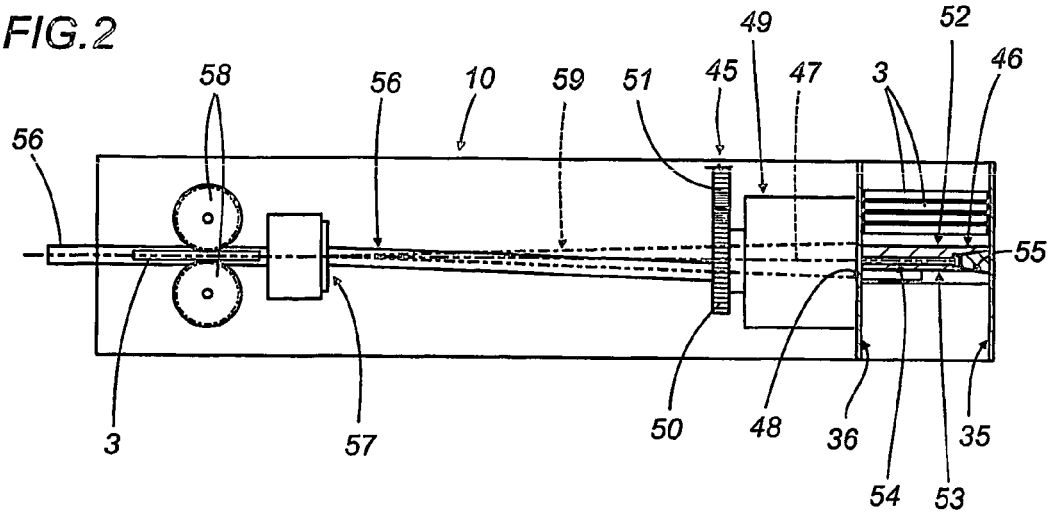
FIG. 2 shows a detail of FIG. 1 illustrated in a different embodiment, viewed schematically and in a side elevation.

In an alternative embodiment of the unit shown in FIG. 2, also described and illustrated in European Patent 523,613, to which reference may be made for a fuller description, filters 3 are supplied to the unit 2 by feed means 10 comprising at least one device 45 by which the filters 3 are introduced axially. The device 45 in question comprises an elongated body 46 extending between the side walls 35 and 36 of the buffer 16 and centred on an axis 47 perpendicular to the walls 35 and 36. The elongated body 46 is insertable through an opening 48 in the wall denoted 36, located in a substantially central position relative to the receiving hopper 8, and connected thus to one end of a cylindrical drum centred on the aforementioned axis 47. The drum in question, not visible in FIG. 2 but clearly described and illustrated in EP 523,613, is rotatable internally of a cylindrical bushing 49 centred on the axis 47 and associated rigidly with the side wall 36. The drum is rotatable as one with a gear 50 aligned concentrically with the axis 47 and in mesh with a driving gear 51 designed to set the drum and the elongated body 46 in rotation about the axis 47 at a predetermined angular velocity. The elongated body 46 presents a substantially cylindrical outer surface 52 of spiral cross-sectional outline, with a lengthwise groove 53. The elongated body 46 is of length substantially equal to the distance between the two side walls 35 and 36 and presents an axial bore 54 of which one end 55, offered to the rear side wall 35, is flared frustoconically. The drum is connected to one end of an axial feed duct 56 through which the filters 3 are carried toward the buffer, the other end of the duct being connected to a ball joint 57 located downstream, relative to the direction along which the filters 3 advance toward the receiving hopper 8, of a pair of rollers 58 by which the filters are taken up and directed along the duct 56.

In operation, the rotary motion of the drum internally of the bushing 49 is accompanied by a rotation of the elongated body 46 about the relative axis 47 and a translational movement of the duct 56, downstream of the ball joint 57, describing a cone denoted 59 in FIG. 2. The rotation of the elongated body 46 within the mass of filters 3 occupying the hopper 8 has the effect of distancing these same filters 3 from the axis 47 and creating a void that can be filled by the filters 3 directed along the duct 56 by the rollers 58.

The invention claimed is:

1. A unit for feeding filters to a filter tip attachment machine, comprising a feeder by which filters are introduced, a feed channel along which the filters are advanced, and connected to the outlet end of the channel, a dispensing hopper from which the filters are released to an infeed portion of the filter tip attachment machine, a storage buffer having variable volume interposed between the feeder and the feed channel; and a movable wall for varying the volume of the variable volume storage buffer, wherein the variable volume storage buffer extends above and parallel to the feed channel and is delimited on an underside by a bottom wall extending transversely to the movable wall, the bottom wall also delimiting an upperside of the feed channel, the feed channel delimited on an underside by a conveyor belt.

2. A unit as in claim 1, comprising: a receiving hopper associated with the feeder by which the filters are introduced and supplying the feed channel; a first monitoring and control mechanism for monitoring and controlling a level of the mass of filters occupying the receiving hopper; and a mechanism for varying the volume of the variable volume storage buffer, interlocked to the first monitoring and control mechanism.

3. A unit as in claim 1, wherein the variable volume storage buffer includes an infeed section associated with the receiving hopper.

4. A unit as in claim 1, and further comprising a drive mechanism for operating the movable wall.

5. A unit as in claim 4, wherein the bottom wall is rigidly associated with the movable wall and includes a top branch of a conveyor belt associated with a motor.

6. A unit as in claim 5, wherein the feed channel along which the filters advance comprises a conveyor belt extending beneath and parallel to the drive mechanism of the movable wall and associated with a respective further drive mechanism.

7. A unit as in claim 6, wherein the dispensing hopper comprises a second monitoring and control mechanism for monitoring and controlling a level of the mass of filters occupying the dispensing hopper, to which the drive mechanism of the conveyor belt is interlocked.

8. A unit as in claim 7, wherein the variable volume storage buffer includes two side walls disposed mutually parallel and substantially perpendicular to the bottom wall, and is equipped with a mechanism for varying a distance between the two side walls, to allow changing a transverse dimension of the variable volume storage buffer.

9. A unit as in claim 8, wherein the feeder introducing the filters comprise at least one diverter device by which the filters are directed transversely to their axes into the receiving hopper.

10. A unit as in claim 8, wherein the feeder introducing the filters comprise at least one device by which the filters are directed axially into the receiving hopper.

11. A unit as in claim 1, wherein the feed channel along which the filters advance comprises a conveyor belt extending beneath and parallel to the drive mechanism of the movable wall and associated with a respective further drive mechanism.

12. A unit as in claim 11, wherein the dispensing hopper comprises a second monitoring and control mechanism for monitoring and controlling a level of the mass of filters occupying the dispensing hopper, to which the drive mechanism of the conveyor belt is interlocked.

13. A unit as in claim 1, wherein the variable volume storage buffer includes two side walls disposed mutually parallel and substantially perpendicular to the bottom wall, and is equipped with a mechanism for varying a distance between the two side walls to allow changing a transverse dimension of the variable volume storage buffer.

14. A unit as in claim 1, wherein the feeder introducing the filters comprise at least one diverter device by which the filters are directed transversely to their axes into the receiving hopper.

15. A unit as in claim 1, wherein the feeder introducing the filters comprise at least one device by which the filters are directed axially into the receiving hopper.

16. A unit for feeding filters to a filter tip attachment machine, comprising a feeder by which filters are introduced, a feed channel along which the filters are advanced, and connected to the outlet end of the channel, a dispensing hopper from which the filters are re1eased to an infeed portion of the filter tip attachment machine, a variable volume storage buffer interposed between the feeder and the feed channel; wherein the unit comprises a movable wall which delimits a portion of the variable volume storage buffer and by which the volume of the variable volume storage buffer can be varied, and wherein the unit also comprises a receiving hopper supplying the feed channel and associated with the feeder by which the filters are introduced; a first monitoring and control mechanism for monitoring and controlling a level of the mass of filters occupying the receiving hopper; and a mechanism for moving the movable wall, interlocked to the monitoring and controlling mechanism, for varying the volume of the variable volume storage buffer.

17. A unit for feeding filters to a filter tip attachment machine, comprising a feeder by which filters are introduced, a feed channel along which the filters are advanced, and connected to the outlet end of the channel, a dispensing hopper from which the filters are released to an infeed portion of the filter tip attachment machine, a variable volume storage buffer, interposed between the feeder and the feed channel and delimited at the bottom by a wall comprising a top branch of a conveyor belt moved by a motor and looped at opposite ends around an upstream pulley and a downstream pulley; associated rigidly with the top branch of the belt being a bottom end of a substantially vertical wall rendered capable of movement, generated by the motor, between two limit positions of which the first corresponds to a condition of minimum capacity afforded by the variable volume storage buffer and the second corresponds to a condition of maximum capacity afforded by the variable volume storage buffer, wherein the variable volume storage buffer includes two side walls disposed mutually parallel and substantially perpendicular to the bottom wall, and is equipped with a mechanism for varying a distance between the two side walls, to allow of changing a transverse dimension of the variable volume storage buffer.

* * * * *